US007263465B2

(12) United States Patent
Turley et al.

(10) Patent No.: US 7,263,465 B2
(45) Date of Patent: Aug. 28, 2007

(54) PIPELINE INTEGRITY MANAGEMENT PROCESS

(75) Inventors: Richard D. Turley, Findlay, OH (US); Debra S. Feigert, Findlay, OH (US); Donald J. Stechschulte, Columbus Grove, OH (US); J. Charles Jones, Findlay, OH (US); Dennis C. Johnston, Wothington, OH (US); Dennis C. Hucke, Findlay, OH (US); George L. Guinn, Friendswood, TX (US); Bryan P. Melan, Cypress, TX (US); Thomas A. Jones, Findlay, OH (US); Nina M. Schmits, Findlay, OH (US); Douglas T. Carr, Findlay, OH (US); Raymond W. Price, Canton, MI (US); Steven T. Ross, Findlay, OH (US); Andrew W. Kendrick, Pittsburgh, PA (US); David E. Siebold, Findlay, OH (US)

(73) Assignee: Marathon Ashland Petroleum LLC, Findlay, OH (US)

( * ) Notice: Subject to any disclaimer, the term of this patent is extended or adjusted under 35 U.S.C. 154(b) by 0 days.

(21) Appl. No.: 11/010,242

(22) Filed: Dec. 10, 2004

(65) Prior Publication Data

US 2006/0129338 A1 Jun. 15, 2006

Related U.S. Application Data

(60) Provisional application No. 60/528,751, filed on Dec. 11, 2003.

(51) Int. Cl.
*G06F 11/30* (2006.01)

(52) U.S. Cl. ..... 702/182

(58) Field of Classification Search ..... 702/182, 702/34, 185; 715/782; 73/865.8, 885.8; 705/9

See application file for complete search history.

(56) References Cited

U.S. PATENT DOCUMENTS

| | | | | |
|---|---|---|---|---|
| 5,726,884 | A * | 3/1998 | Sturgeon et al. | 705/9 |
| 6,885,948 | B2 * | 4/2005 | Dupuis et al. | 702/34 |
| 6,970,808 | B2 * | 11/2005 | Abhulimen et al. | 702/185 |
| 2004/0031337 | A1 * | 2/2004 | Masaniello et al. | 73/865.8 |
| 2004/0243321 | A1 * | 12/2004 | Pittalwala et al. | 702/34 |
| 2006/0075356 | A1 * | 4/2006 | Faulkner et al. | 715/782 |

OTHER PUBLICATIONS

Managing System Integrity for Hazardous Liquid Pipelines; American Petroleum Institute; API Standard 1160; First Edition, Nov. 2001.

* cited by examiner

*Primary Examiner*—John Barlow
*Assistant Examiner*—Xiuqin Sun
(74) *Attorney, Agent, or Firm*—Emch, Schaffer, Schaub & Porcello Co., L.P.A.

(57) ABSTRACT

A method for reducing the consequences and risks of failure in a hydrocarbon pipeline system includes identifying specific segments of pipelines the leakage of which could have an adverse impact on environment or safety, particularly in areas of high consequence, developing a baseline assessment plan for such segments by analyzing information including age, corrosion, and types of seams and joints and then establishing preventive and migitative measures including, where necessary, positioning emergency flow restricting devices in one or more pipeline segments.

4 Claims, 11 Drawing Sheets

Baseline Threat Assessment

Baseline Risk Ranking Steps

Developing Assessment Response Strategies

Steps for Continuous Improvement for Risk Assessment and Preventative and Mitigative Measures Phases

PIPELINE INTEGRITY MANAGEMENT PROCESS

CROSS REFERENCE TO RELATED APPLICATION

The present application is based upon and claims the benefit of Provisional Application No. 60/528,751 filed Dec. 11, 2003.

BACKGROUND OF THE INVENTION

The present application is directed to a method for reducing the consequences and likelihood of failures in a hydrocarbon pipeline system. This invention is designed to assist pipeline owners and operators in achieving compliance with the U.S. DOT OPS Integrity Management Regulations and to meet various State regulations. See 49 C.F.R. 195.452, incorporated herein by reference.

The United States Department of Transportation (DOT) Research and Special Programs Administration requires that pipeline owners or operators of greater than 500 miles of hydrocarbon pipelines develop a written integrity management program that addresses the risks on each pipeline segment that could affect a High Consequence Area, as hereinafter defined.

As part of this DOT requirement, the pipeline operators program must include as set forth in 49 CFR 195.452(f):

(i) An identification of all pipeline segments that could affect a High Consequence Area.

(ii) A plan for baseline assessment of the line pipe.

(iii) Integration of all information about the integrity of the entire pipeline.

(iv) Remedial actions to address integrity issues (v) Continual assessment and evaluation to maintain pipeline integrity (vi) Implementation of preventive and mitigative measures (vii) Program effectiveness measurement (viii) Integrity results review by qualified personnel The present invention provides a method for fulfilling the requirements of regulations in an effective and expeditious manner.

Definitions

Assessment Method—A process or specific type of testing procedure used to evaluate a pipeline for integrity.

Could Affect High Consequence Area (CHCA)—A pipeline or asset that has the potential to produce a spill volume or release of airborne vapors that intersects a high consequence area boundary.

Emergency Flow Restricting Device (EFRD)—Refers to either a check valve or remote control valve. A check valve is a valve that allows fluid to flow freely in one direction only and contains a mechanism to automatically prevent flow in the other direction. A remote control valve is any valve that is operated from a location remote from where the valve is installed.

Geographic Information System (GIS)—A computerized database system for capturing, storing, analyzing and displaying geographic information.

High Consequence Area (HCA)—Any high population area, other populated area, commercially navigable waterway, drinking water area or ecological area.

Integrity Management Program (IMP)—The entire set of procedures and methods used to reduce the consequences and likelihood of failures in a hydrocarbon pipeline system.

Integrity Threat—A condition or series of conditions that could affect the serviceability or soundness of a pipeline. Primary integrity threats are identified by pipeline integrity leaders as having the greatest risk to the line pipe segment soundness and will be assessed during the baseline assessment process.

Preventative and Mitigative Measures (PMM)—Any effort put forth to prevent a pipeline or asset failure or to make the consequence of the failure less severe or intense.

U.S. DOT OPS—United States Department of Transportation Office of Pipeline Safety.

Program Overview

This Integrity Management Program was developed to reduce the consequences and likelihood of failures which could present adverse environmental or safety concerns in a hydrocarbon pipeline system. The invention is also designed to bring pipeline owners and operators into compliance with the U.S. Department of Transportation (DOT) 49 CFR 195.452. The process also includes systems for maintaining compliance in the event of changes in a pipeline system due to expansion or decommissioning of segments.

The present invention includes identification of potential High Consequence Areas that could be adversely affected by pipeline or storage tank ruptures or releases and a number of steps to be taken in response to failures or imminent failures.

IN THE DRAWINGS

DETAILED DESCRIPTION OF THE PREFERRED EMBODIMENTS

Figure 1:
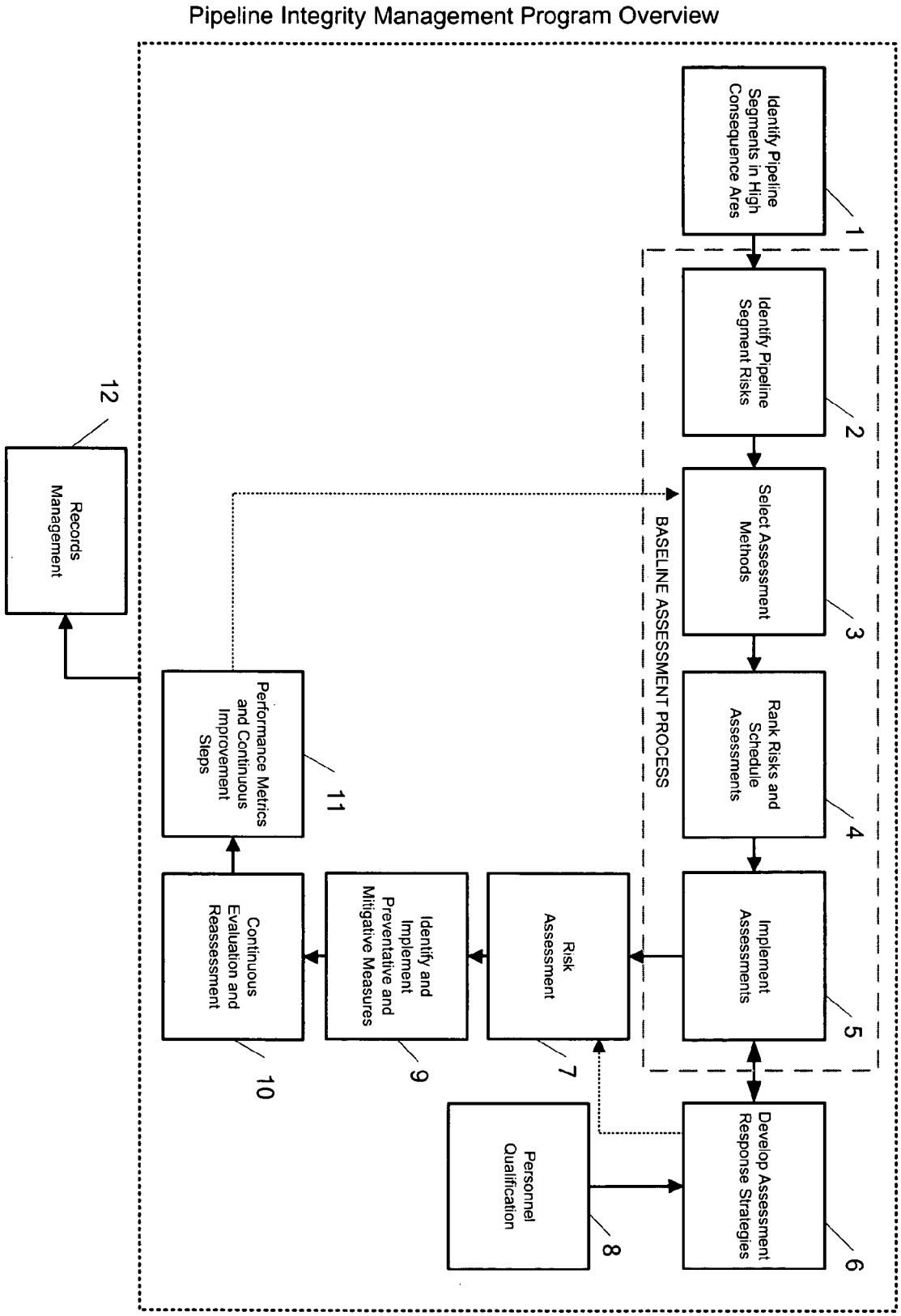
FIG. 1 is a block diagram setting forth an overview of the integrity management program of the present invention.

The Pipeline Integrity Management program begins by identifying pipeline segments and facilities that could affect a high consequence area (FIG. 1, Item 1). After segments are identified, potential integrity threats to those segments are identified including structural anomalies, seam integrity and other threats that could lead to a spill (FIG. 1, Item 2).

In FIG. 1, Item 3 a process for selecting proper assessment methods for individual pipeline segments is used, and assessments are scheduled based on relative risks (FIG. 1, Item 4). Pipelines identified at risk are assessed or tested (FIG. 1, Item 5) and assessment response strategies are developed (FIG. 1, Item 6). Specific pipeline threats are assessed to determine degree of risk (FIG. 1, Item 7). Preventative and Mitigative Measures over and above those used in normal day-to-day operations that may reduce the chances of or consequences of a spill from a pipeline at risk are identified and where necessary implemented (FIG. 1, Item 9) and pipelines are reassessed (FIG. 1, Item 10). The program of the present invention also includes steps for Continuous Improvement through program metrics analysis (FIG. 1, Item 11), Personnel Qualification (FIG. 1, Item 8) and procedures for Records Management (FIG. 1, Item 12).

With respect to the specifics, once the pipelines and other assets are identified, a computerized database system such as a Geographic Information System (GIS) captures, stores, analyzes and displays geographic information with respect to each segment lying within the HCA. After obtaining up-to-data regarding the HCA, an estimate is made of the worst case release volumes using three dimensional modeling to predict spill areas. Maps and documents are prepared so that an analysis can be made of those pipeline segments which could affect a high consequence area.

An important feature of the program is to have in effect procedures which show continuous improvement to the overall process. This includes preparing updates for the computerized database system showing geographic information system (GIS) for various pipeline segments, identifying new segments that could affect HCAs and communicating changes in pipeline segments or HCAs including the identification of inactive segments.

Identify Pipeline Segments in High Consequence Areas

Figure 2:
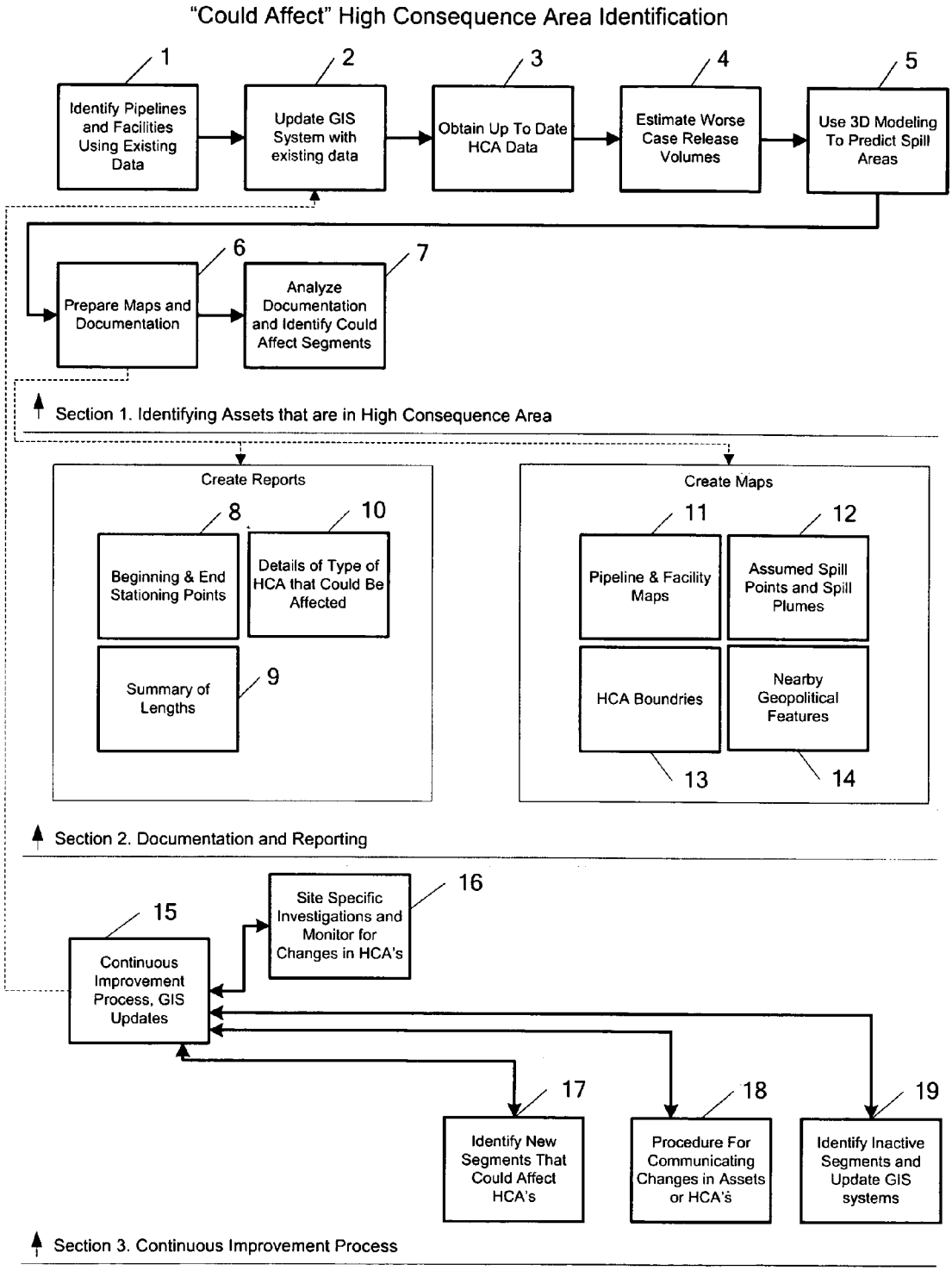
FIG. 2 is a block diagram showing procedures for identifying pipeline segments which could affect HCA's.

FIG. 2 describes the pipeline identification process in greater detail including the three main sections. The sections include (Section 1) identifying assets that Could Affect High Consequence Areas (CHCA's) (as previously defined) in the case a pipeline or facility spill or rupture; (Section 2) a standardized reporting and documentation process; and (Section 3) a process for continuous improvement of record keeping and keeping all records up to date.

Existing pipelines and facilities are initially identified using existing records (FIG. 2, Item 1).

Next, the existing pipeline and facility data is entered into a corporate Geographic Information System (GIS). The GIS is a computerized database system for capturing, storing, analyzing and displaying geographic information.

The next component of the identification process is to obtain up-to-date HCA data as specified in 49 CFR 195.452 (FIG. 2, Item 3).

After High Consequence Areas are defined, worse case release volumes are determined (FIG. 2, Item 4). These release volumes refer to the amount of liquid that could potentially spill from a pipeline segment or facility in the case of a rupture or accident. Worse case release volumes are established by considering both liquid spills and air-borne vapor dispersion. In the case of a pipeline rupture, the potential spill volume is calculated by two parts. First, the volume that could travel through the specific pipe in 10 minutes is calculated. This is based on the assumption that a rupture could be identified in 10 minutes and the two closest Motor Operated Valves (MOV's) could be closed. The second part of the rupture spill volume calculation considers any additional spillage running out of the pipeline due to gravity and elevation.

Worse Case Storage Tank Release Volumes (tanks) are determined through a location by location survey and vary by location.

After determining location data of pipelines and tank facilities, location data of HCA's and Worse case release volume data, 3D spill modeling software is used to predict the potential spread of spilled liquids (FIG. 2, Item 5). Buffer or impact zones are also identified to simulate the potential air-borne dispersion of vapors. This phase utilizes third party tools and techniques with terrestrial and hydrological modeling to identify and locate potential spill zones and how they could impact an HCA.

In the next step of the process (FIG. 2, Item 6), documentation consisting of maps and reports are prepared by using a computer-based interface which runs on and is accessible via a corporate intranet. Users may create reports and/or maps for any company operated pipeline systems covered in the integrity management program.

In the Report section of the interface, users may generate reports that provide the following information:

- Beginning and end stationing points (FIG. 2, Item 8)
- Summary of the lengths of each CHCA (Could Affect High Consequence Area) segment (FIG. 2, Item 9)
- Details of what type of HCA could be impacted (FIG. 2, Item 10)

In the mapping section of the interface, users may create maps that show:

- Pipelines and Facilities (FIG. 2, Item 11)
- Assumed spill points and spill plumes (FIG. 2, Item 12)
- HCA boundaries (FIG. 2, Item 13)
- Nearby geopolitical features such as state and county borders, rivers, and roadways. (FIG. 2, Item 14)

Maps are prepared through use of a third-party software product, specifically, ArcIMS, which runs on an Internet Server Computer and allows users to dynamically create maps via intranet web pages. ArcIMS is sold by ESRI located at Redlands, Calif.

By analyzing maps, 'Could Affect' segments can be identified (FIG. 2, Item 7). Could Affect segments are identified as any area where:

- A pipeline passes through a HCA
- Any pipeline segment or facility that produces a spill volume that intersects an HCA boundary.

All of the data used for the documentation described in FIG. 2 is maintained in a company wide Geographic Information Database System (GIS). Also built into this Integrity Management Process are a set of procedures and systems designed for continuous improvement.

The continuous improvement phase includes a number of components including site specific investigations, continuous identification of HCA's that should be included in the program, procedures for keeping all data current, and procedures for identifying new pipeline segments that could affect an HCA. These components are explained in greater detail below.

- Site Specific Investigations (FIG. 2, Item 16) may be performed by pipeline operators to ensure that he or she knows the exact location of relevant HCA's and the specific nature of the HCA. Monitoring changes of such HCA's is performed to identify any changes in could affect segments.
- Procedures for keeping all data current include:
  - An annual review of all HCA information contained in the GIS database and a system for making changes where appropriate.
  - A procedure for identifying how new pipeline systems or new segments added to existing pipeline systems could affect an HCA (FIG. 2, Item 17).
  - A procedure for ensuring that changes in pipeline or HCA data is communicated to the appropriate personnel (FIG. 2, Item 18).

Finally, as part of this identification segment of the integrity management process, inactive pipeline segments are identified (FIG. 2, Item 19) and all data is listed in the GIS database (FIG. 2, Item 15). Inactive segments in this case are those pipeline segments that are temporarily shut down. These lines may be activated again in the future or may be slated for complete decommissioning.

Baseline Assessment Plan

After identifying pipeline segments as described above and outlined in FIG. 2, a baseline threat assessment for those segments is initiated as outlined in FIGS. 3-6.

Figure 4:
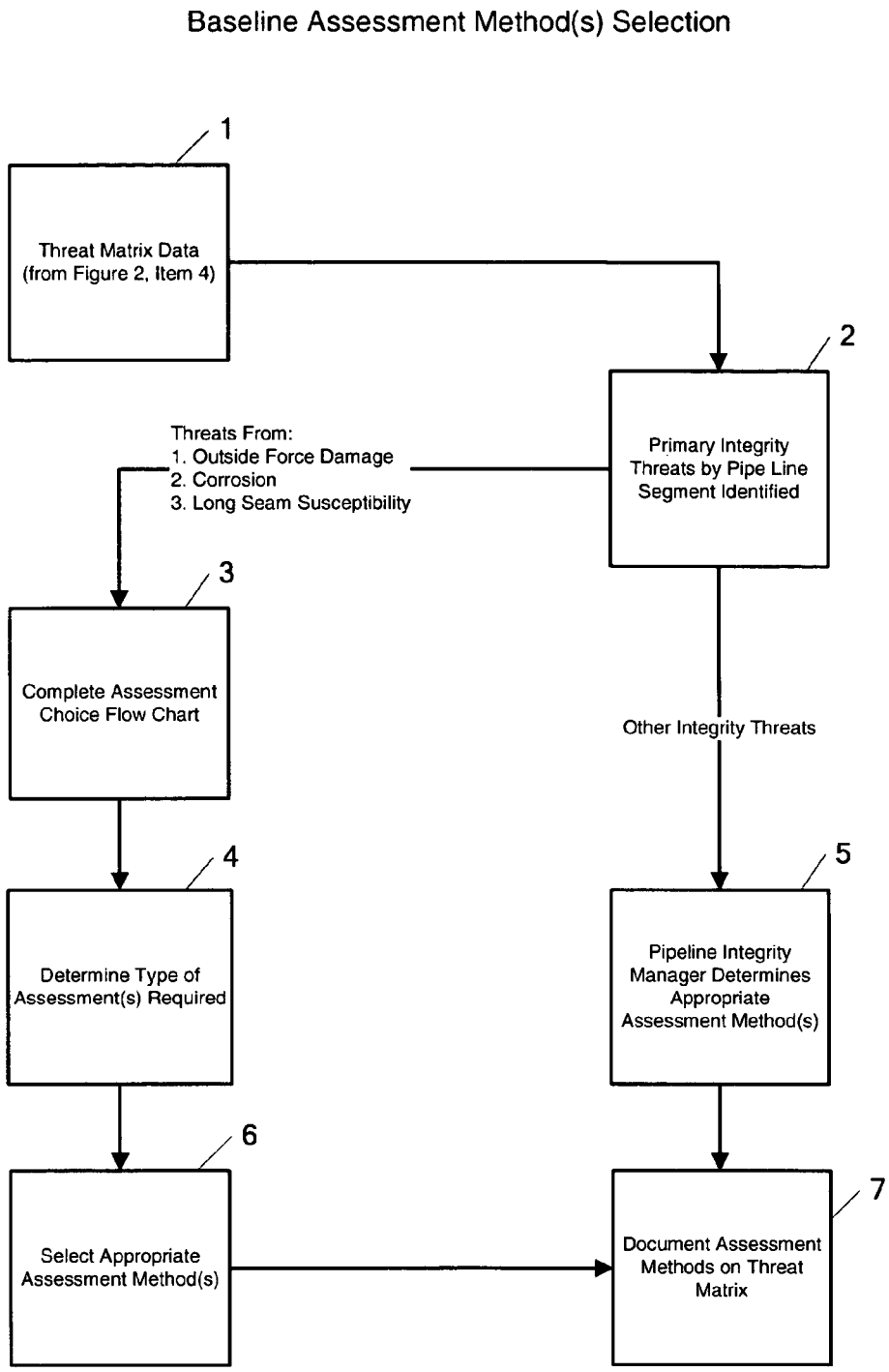
FIG. 4 is a block diagram showing assessment method selection.
Figure 5:
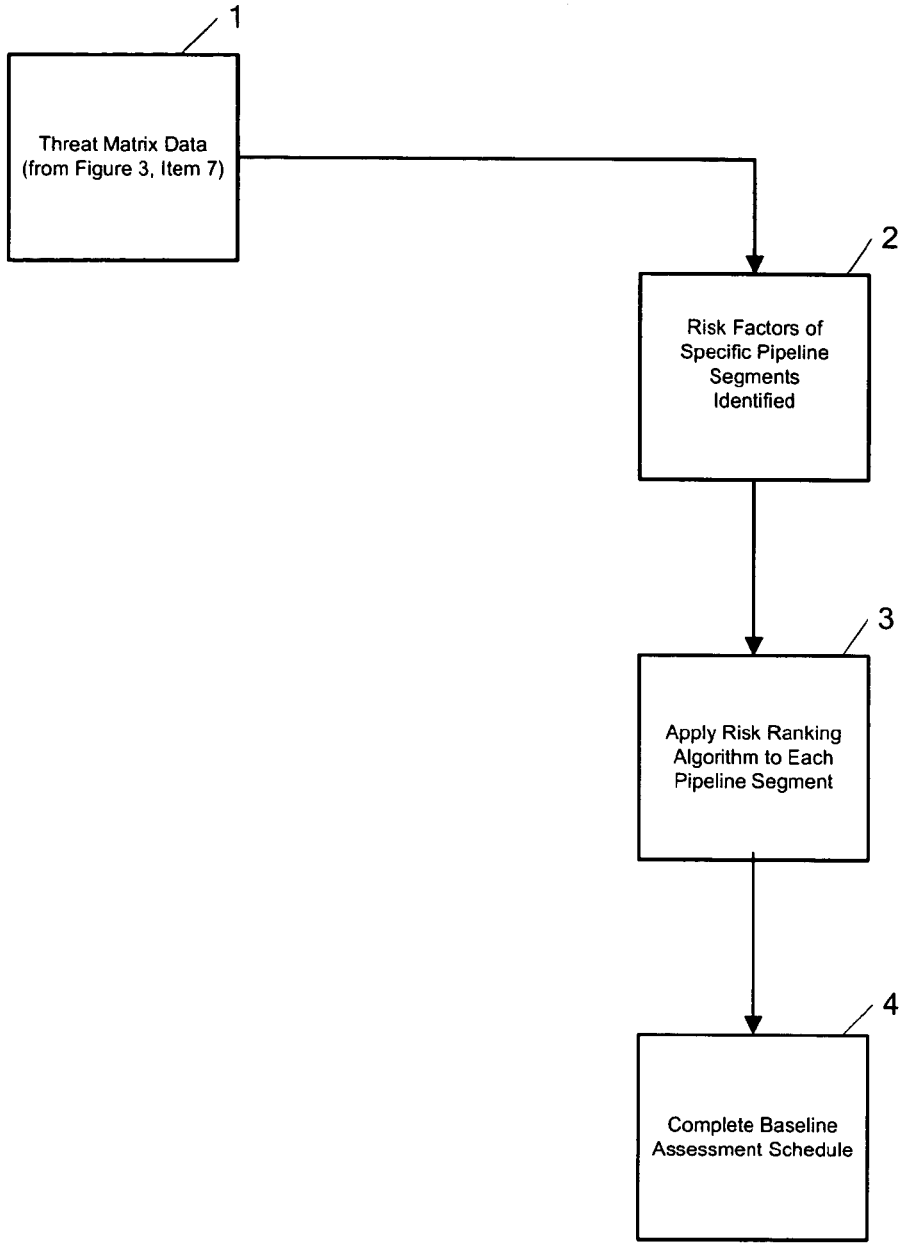
FIG. 5 is a block diagram showing risk ranking steps.

The baseline threat assessment analyzes the integrity of "could affect" pipeline segments by checking for:

- Anomalies caused by corrosion
- Anomalies caused by outside force damage
- Longitudinal seam integrity
- Other integrity threats as identified by a Pipeline Integrity Process Leader The baseline threat assessment analysis has three key steps:

- Threat assessment (FIG. 3)
- Assessment method selection (FIG. 4)
- Risk ranking to establish assessment schedule (FIG. 5)

Baseline Threat Assessment Phase

Figure 3:
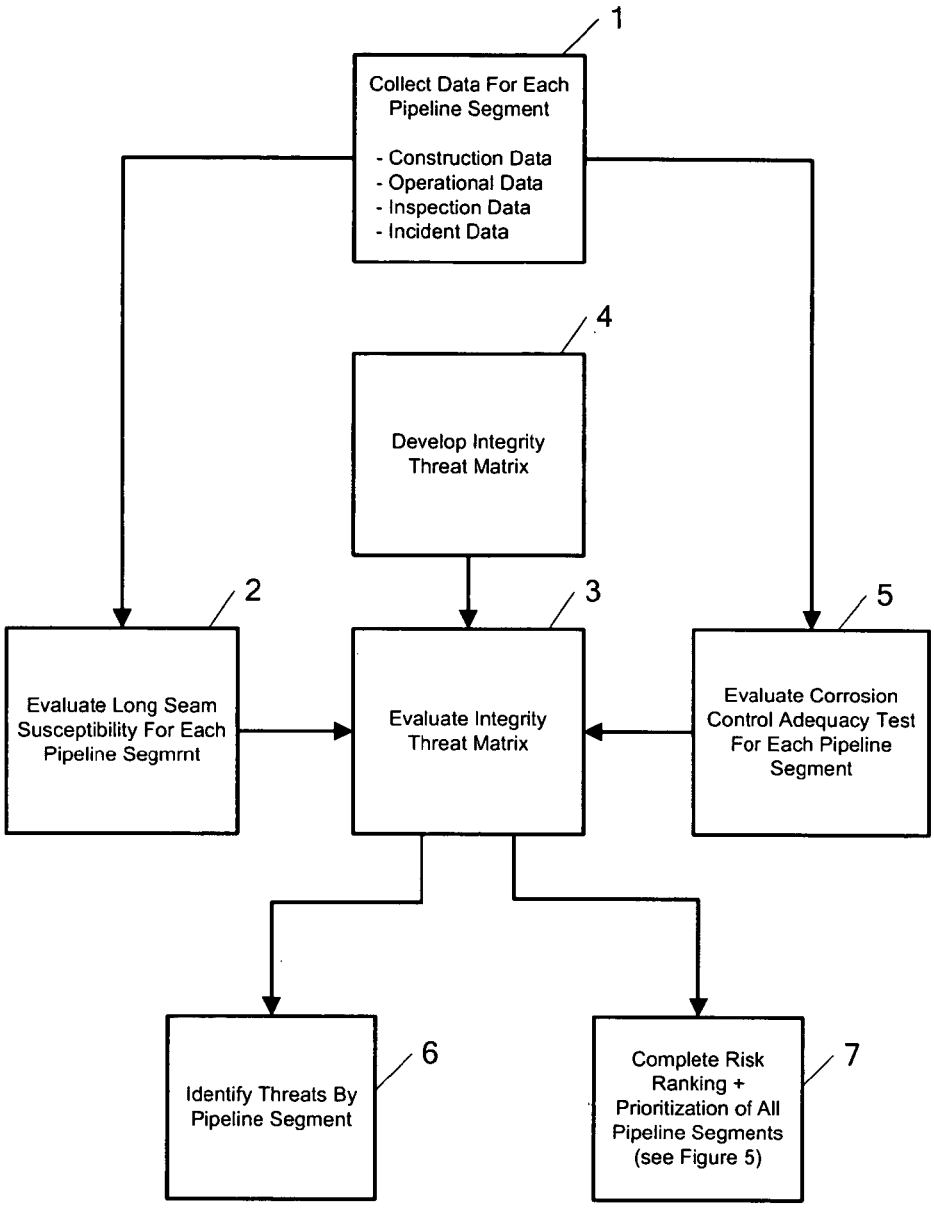
FIG. 3 is a block diagram showing the steps in developing a baseline threat assessment.

The first step of the threat assessment phase is to collect data for each pipeline segment (FIG. 3, Item 1). The data includes:

- Construction data
- Operational data
- Inspection data
- Incident data

For each pipeline segment, the following analyses are implemented during the threat assessment phase:

- Long seam susceptibility criteria analysis
- Corrosion control adequacy test
- Integrity threat matrix The long seam susceptibility analysis (FIG. 3, Item 2) identifies the measure of susceptibility of each pipeline segment. The results of this analysis are used:

- To determine if further assessment is required for longitudinal seam threats
- As data input to an integrity threat matrix data sheet
- As data input to an assessment choice flow chart The corrosion control adequacy test (FIG. 3, Item 5) determines corrosion control performance effectiveness for each pipeline segment. The results of this adequacy test are used:

- To determine if a hydrostatic test can be used as part of the assessment phase based on the effectiveness of the corrosion control program of each segment.
- As data input to an integrity threat matrix data sheet
- As data input to an assessment choice flow chart Using the data obtained from both the long seam susceptibility analysis and the corrosion control adequacy tests along with historic accident and incident reports, an integrity threat matrix is developed (FIG. 3, Item 4). This integrity threat matrix is used to identify and evaluate potential threats to the integrity of each pipeline segment.

Threats that are evaluated include:

1. Natural forces
2. Corrosion—Internal and External
3. Material or weld failures
4. Equipment
5. Excavation Damage
6. Outside Force Damage
7. Incorrect Operations
8. Other The integrity threat matrix is a computerized spreadsheet used to identify and evaluate potential threats to the integrity of a pipeline segment. An individual pipeline segment may have multiple integrity threats identified. Utilizing the integrity threat matrix along with other available data, Pipeline Integrity Process leaders and subject matter experts evaluate possible integrity threats and determine what assessment methods are required for a specific pipeline segment.

The results of the Integrity Threat Matrix are used to:

- Identify potential integrity threats for each pipeline segment.
- As data input for making assessment method choices.
- As data input for the baseline ranking process.

The Integrity Threat Matrix is developed through the following steps:

Identify all potential integrity threats to line pipe segments:

- Form RSPA F 7000-1 DOT Accident Report—Hazardous Liquid Pipeline Systems is used to initially identify potential integrity threats.
- The 25 integrity threats listed in Part H of Form RSPA F 7000-1 Accident Report—Hazardous Liquid Pipeline Systems are divided into subfactor influences.
- List line pipe segments:
- Identification of Pipeline Segments and Facilities That Could Affect a High Consequence Area (Hazardous Liquids) are listed.
- Identify all potential integrity threats:
- Sources used to identify threats for each IMP line pipe segment include:
  - MAPL Audit & Incident Tracking System (AITS)
  - Past line pipe segment history
    - Construction files
  - System long-term integrity plans
- Results of Long Seam Susceptibility (FIG. 3, Item 2)
- Corrosion Control Adequacy Test (FIG. 3, Item 5)
- Input from the following PI Process Leaders/SMEs:
  - Pipeline Integrity Manager
  - Corrosion Control Supervisor
  - System Integrity Leaders
  - Land Agents
  - System Operation Specialists
  - Process Leader for In-Line Inspection
  - Process Leader for Hydrostatic Testing The integrity threat matrix is evaluated (FIG. 3, Item 3) to identify primary integrity threats (FIG. 3, Item 6) by pipeline segment. The segments are then ranked and prioritized by risk of their integrity threat. (FIG. 3, Item 7) and described in greater detail in FIG. 5.

Assessment Method Selection Process

After the Baseline Threat Assessment is complete as set forth above and in FIG. 3, the required method(s) to fully assess all identified integrity threats is(are) determined (FIG. 4). Pipeline Integrity Process Leaders use a flowchart methodology to determine what inspection tools or other testing methods are required to address primary pipeline segment integrity threats. Integrity threats include corrosion, outside force damage, seam deterioration and other anomalies that may cause a rupture or failure in the pipeline.

The following analyses are completed during the Assessment Method Selection Phase:

- Baseline Assessment Method for primary integrity threats due to outside force damage, corrosion and long seam susceptibility.
- In Line Inspection Tool selection matrix.
- Other technologies flow chart.
- Baseline Threat Assessment for any integrity threats identified as 'Other' threats.

FIG. 4 shows the Assessment Method Selection phase in greater detail. In FIG. 4, Item 1, Threat Matrix Data is the base data used to identify primary integrity threats by pipeline segment (FIG. 4, Item 2). If the primary threat is from outside force damage, corrosion or long seam susceptibility, then a flow chart is used (FIG. 4, Item 3) to determine the type of assessment required (FIG. 4, Item 4).

Figure 11:
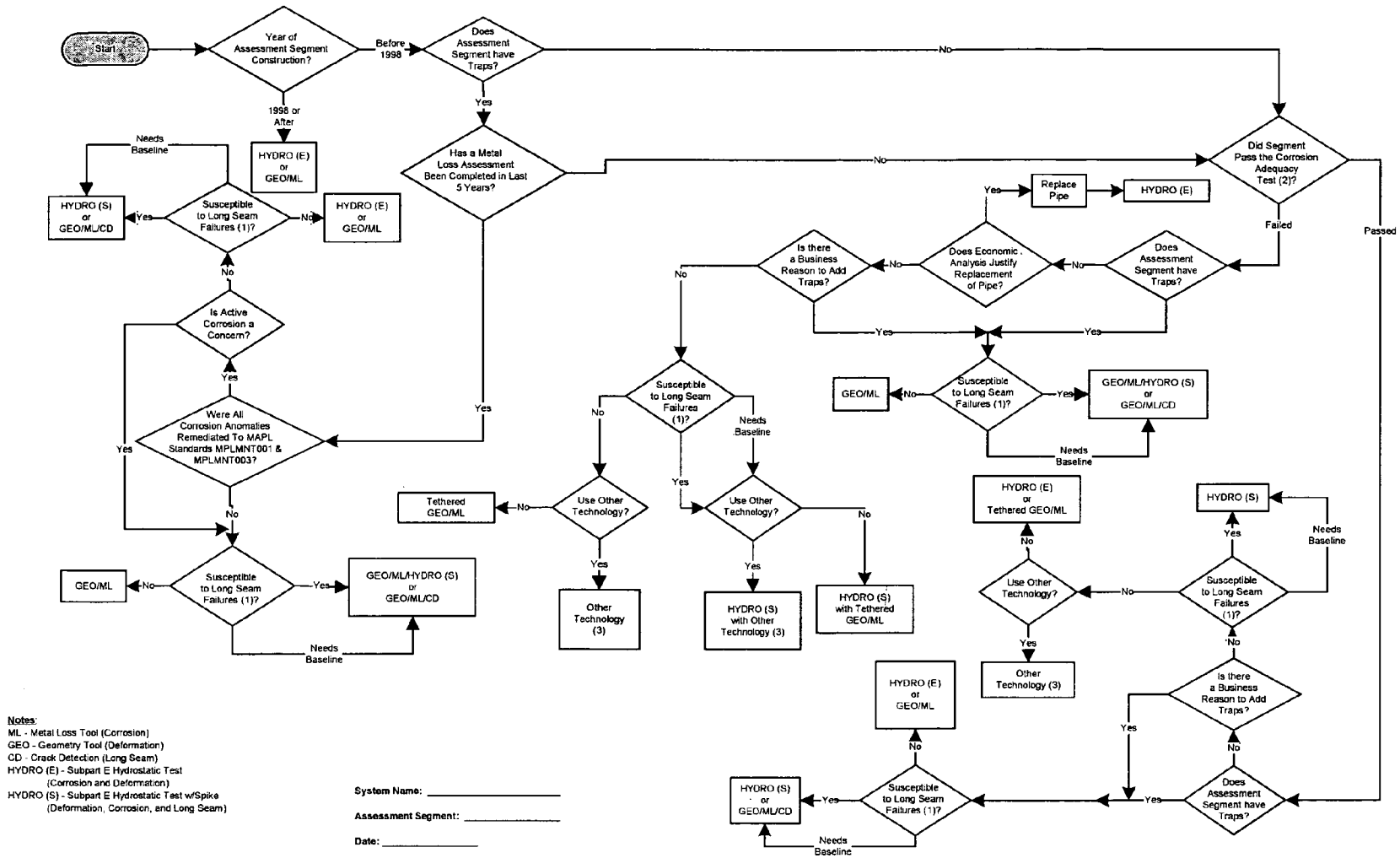
FIG. 11 is an example of an Assessment Choice Flowchart.

An example of the Assessment Choice Flowchart is represented in FIG. 11:

If the primary integrity threat to a pipeline segment is considered an 'other' type of threat, then the Pipeline Integrity Manager determines the appropriate assessment method for that specific segment (FIG. 4, Item 5).

After the appropriate assessment methods are determined (FIG. 4 Items 5-6), the assessment methods are documented on a threat matrix (FIG. 4, Item 7).

With the primary integrity threats for each applicable pipeline segments identified (from FIG. 3, Threat Assessment Process) and the assessment method for each of those segments determined (from FIG. 4 Assessment Method Selection), a risk ranking process (FIG. 5) is established.

Method for Ranking Pipeline Risks for Baseline Assessments

Prioritizing pipeline segments for assessment is based on the data from the Integrity Threat Matrix and additional risk factors. FIG. 5 outlines the risk ranking steps in greater detail.

Along with the data previously compiled for the integrity threat matrix (FIG. 5, Item 1), risk factors for specific pipeline segments are also identified (FIG. 5, Item 2). There are nine risk factors considered:

- Results of previous tests and assessments
- Pipeline segment physical data including material of construction and seam type
- Leak history
- Product(s) transported
- Operating stress level
- Existing activities in geographic area
- Environmental factors that could affect the pipe segment
- Geotechnical hazards (e.g. earthquakes, avalanches, etc)
- Physical support of pipe (on supports, suspension bridge, etc).

Based on these risk factors, a risk ranking algorithm is developed (FIG. 5, Item 3). By applying the risk ranking algorithm and other scoring factors, such as type of HCA and length of a "could affect" segment spill area, each pipeline segment is given a relative risk score to complete the Baseline Assessment Schedule (FIG. 5, Item 4). Assessment scheduling is determined by the risk score.

Risk Assessment

Figure 6:
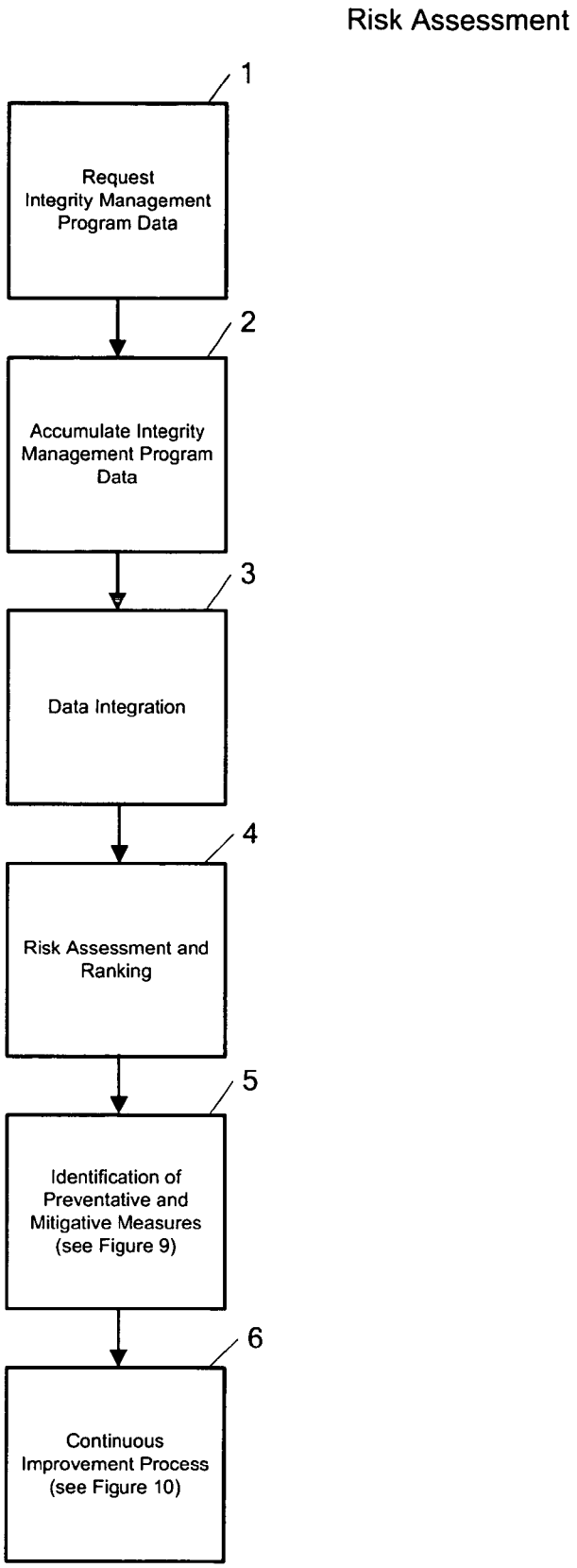
FIG. 6 is a block diagram showing risk assessment phase.

Referring to FIG. 6, there is shown a Risk Assessment Phase which is a set of steps used to identify and prioritize pipeline integrity risks and is used as a basis for determining what preventative and mitigative measures may be taken to minimize or eliminate the risks. The risk assessment phase is also used to meet the requirements of 49 CFR 195.452.

The Risk Assessment Phase combines multiple steps into a single phase. These steps include:

- The requesting of Integrity Management Program (IMP) data.
- The accumulation of IMP data.
- Integration of IMP data.
- Risk assessment procedures including ranking.
- Identification of preventative and mitigative measures.
- Continuous improvement.

The Risk Assessment Phase starts with a Risk Management Professional (RMP) who identifies the appropriate people responsible for data for a specific pipeline asset. The RMP sends a request for data for the specific pipeline asset to such responsible people (FIG. 6, Item 1).

Next, the appropriate IMP data is accumulated either by accessing a company wide database and/or by electronic mail transmittal from the data responsible person to the RMP. The data is validated by the RMP (FIG. 6, Item 2).

Next, the pipeline asset data is integrated into a computerized database and made accessible on a single report or on a common computerized user interface (FIG. 6, Item 3). The data is verified at this point to ensure that the integration process captured all of the information accurately.

When the data integration for a specific pipeline asset is completed, the risk management database is updated and the Risk Assessment step can be executed (FIG. 6, Item 4). The Risk Assessment step at this stage involves processing the IMP data using third party computer software that ranks relative risks of failures that may result in a rupture or spill from a given pipeline asset. These risks are then further ranked as "Low", "Medium" or "High" priority using proprietary computer software. Such proprietary computer software is described in U.S. patent application Ser. No. 10/864,129, filed Jun. 9, 2004 which is owned by the Assignee of the present invention and incorporated herein by reference.

The results of the Risk Assessment Phase as described above (FIG. 6, Items 1-4) determine whether Preventative and Mitigative Measures are warranted for a specific pipeline asset (FIG. 6, Item 5). The Preventative and Mitigative Measures (described in greater detail in FIG. 9) manage risks by evaluating the benefit of potential risk reduction projects.

The Risk Assessment Phase concludes with a continuous improvement step (FIG. 6, Item 6). This step captures and implements any enhancements that will continuously improve the overall Risk Assessment Phase.

Figure 7:
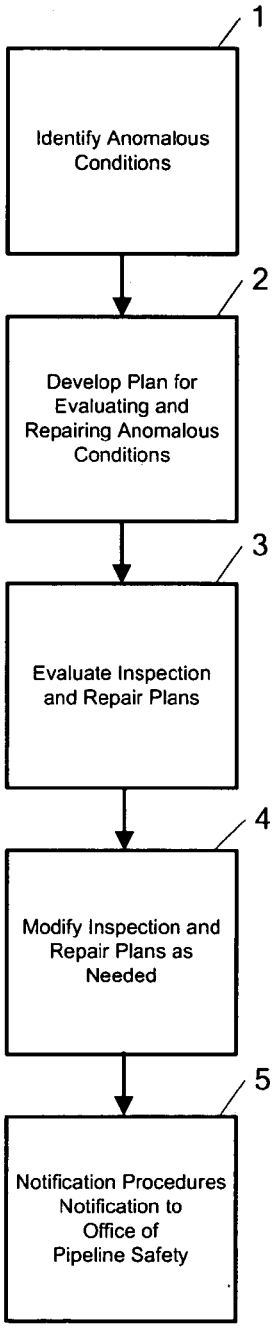
FIG. 7 is a block diagram showing the steps for developing assessment response strategies.

Developing Assessment Response Strategies (FIG. 7)

Another element of the Integrity Management Program is a phase for addressing response strategies and developing remedial actions for any identified pipeline integrity issues. Response strategies are developed to address anomalous conditions discovered through integrity assessment and information analysis. Anomalous conditions that could reduce the integrity of a pipeline segment that could affect a High Consequence Area are identified and procedures are implemented to effectively remediate said conditions.

Anomalous conditions for specific pipeline segments are identified through analysis of historical records and from the baseline threat assessment data (FIG. 3, Item 1 and FIG. 7, Item 1). This data is verified and organized for integration with existing assessment data and analyzed. The results of this analysis are used to produce a plan for the mitigation and/or remediation of any anomalous conditions.

All identified anomalous conditions for a pipeline segment are evaluated, investigated and documented by a Rehabilitation Project Leader. Anomalies are prioritized and plan is then developed to remediate/rehabilitate the specific anomalies (FIG. 7, Item 2) for any pipeline segment as required by 49 CFR 195.452.

The remediation plans are presented to pipeline segment stakeholders and are evaluated (FIG. 7, Item 3).

If necessary, the remediation plan is modified through stakeholder feedback. Any modifications to the remediation plan take into account risks to public safety and environmental protection (FIG. 7, Item 4). Required notifications, when warranted, are made to US DOT OPS during the execution of remediation plans (FIG. 7, Item 5).

Continuous Evaluation and Reassessment

Figure 8:
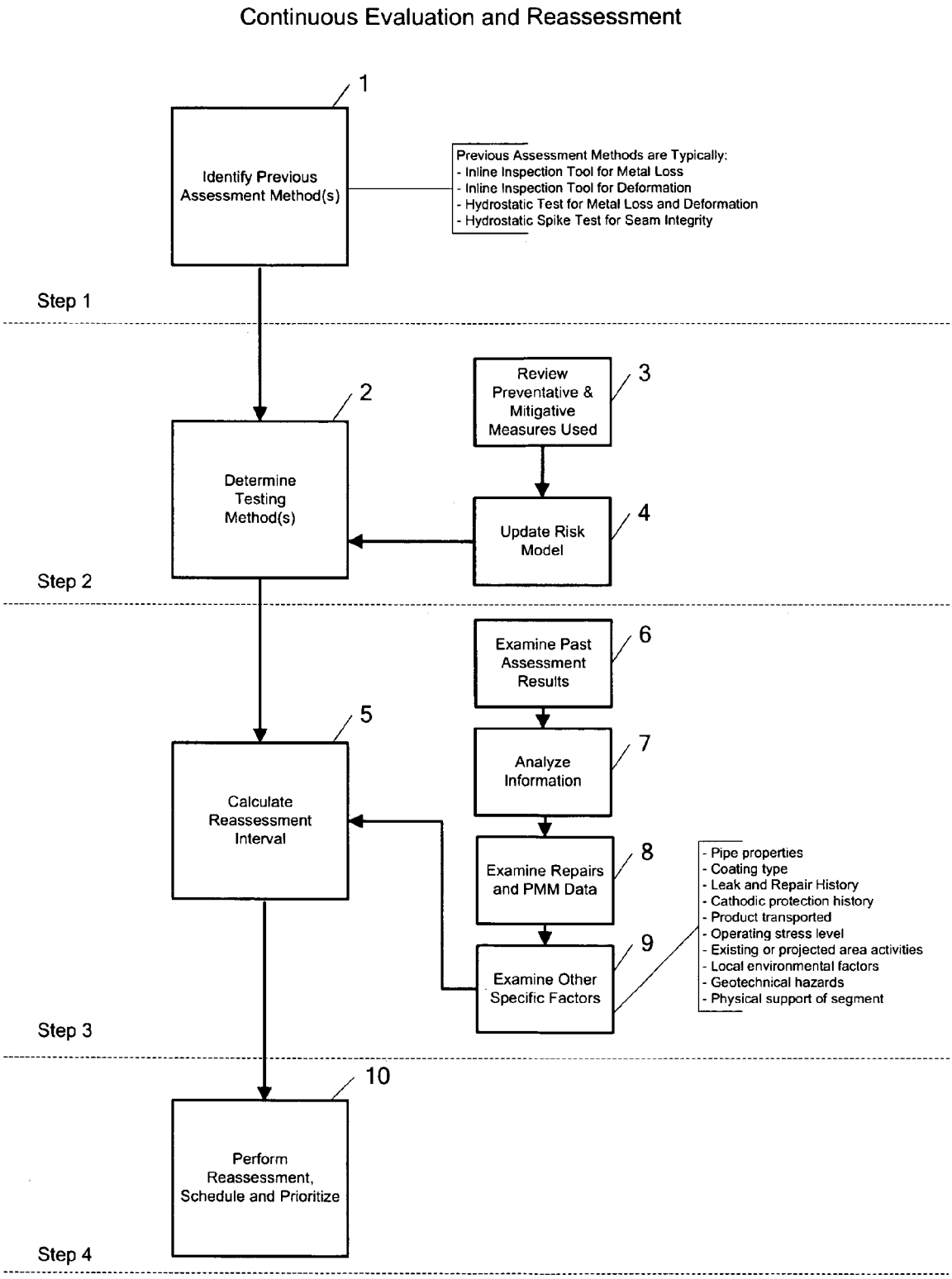
FIG. 8 is a block diagram showing continuous evaluation and reassessment of results.

FIG. 8 sets forth steps for Evaluation and Reassessment of pipeline segment integrity and measures to take based upon all appropriate data developed. This includes procedures used to meet the requirements specified in the Department of Transportation 49 CFR 195.452. The reassessment phase is closely integrated with other elements of the Integrity Management Program and is broken down into four major steps.

Step 1 (FIG. 8, Item 1) includes identifying specific pipeline segments and reviewing existing data for each pipeline segment. Pipeline segments evaluated during this step have completed either a baseline assessment (see FIG. 4, Items 4 & 5) or a subsequent reassessment. This step involves identifying the testing method(s) previously used on pipeline segments which are typically one of the following:

Inline inspection tool for metal loss.

Inline inspection tool for deformation.

Hydrostatic test for metal loss and deformation.

Hydrostatic spike test for seam integrity.

Step 2 of the reassessment phase includes determining the appropriate testing method(s) (FIG. 8, Item 2) for a pipeline segment, which may include a review of preventive and mitigative measures used on such pipeline segment and an update of a risk model. Upon reviewing the previous integrity assessments and risk analysis, a determination is made to select the appropriate testing method(s) for a given pipeline segment.

Following review, selection and, where appropriate, implementation of preventative and mitigative measures, the risk model is updated (FIG. 8, Items 3-4). Risk model data is used in determining the appropriate testing method(s). By using this process of reviewing and incorporating risk data assures that the reassessment methods are based on the latest available data and are appropriate for the specific integrity issues and risks identified.

Step 3 of the reassessment method includes calculating an appropriate time interval for reassessment (FIG. 8 Item 5). Determining the appropriate time interval for reassessments involves considering a number of pipeline segment specific factors including the following required by 49 CFR 195.452:

Past and present integrity assessment results (FIG. 8, Item 6)

Information analysis (FIG. 8, Item 7)

Decisions about repairs and preventative and mitigative measures implemented (FIG. 8, Item 8)

Other specific factors (FIG. 8, Item 9) including:

1. Pipe properties
2. Coating type
3. Leak history, repair history
4. Cathodic protection history
5. Product Transported
6. Operating stress level
7. Existing or projected activities in the area
8. Local environmental factors
9. Geotechnical hazards
10. Physical support of the segment Each of the above factors is weighted based upon actual pipeline segment conditions calculation of weighting factor's yields reassessment intervals of three to fourteen years.

In Step 4 of the evaluation and reassessment (FIG. 8, Item 9), the reassessment on the pipeline segment is scheduled and performed. Upon determination of the appropriate reassessment time interval in Step 3, a reassessment schedule is developed and pipeline segments are prioritized for reassessment. The reassessment prioritization step takes into account results from previous testing. Reassessments are performed as scheduled and the results are documented in accordance with a records management standard.

Identifying Preventative and Mitigative Measures

Figure 9:
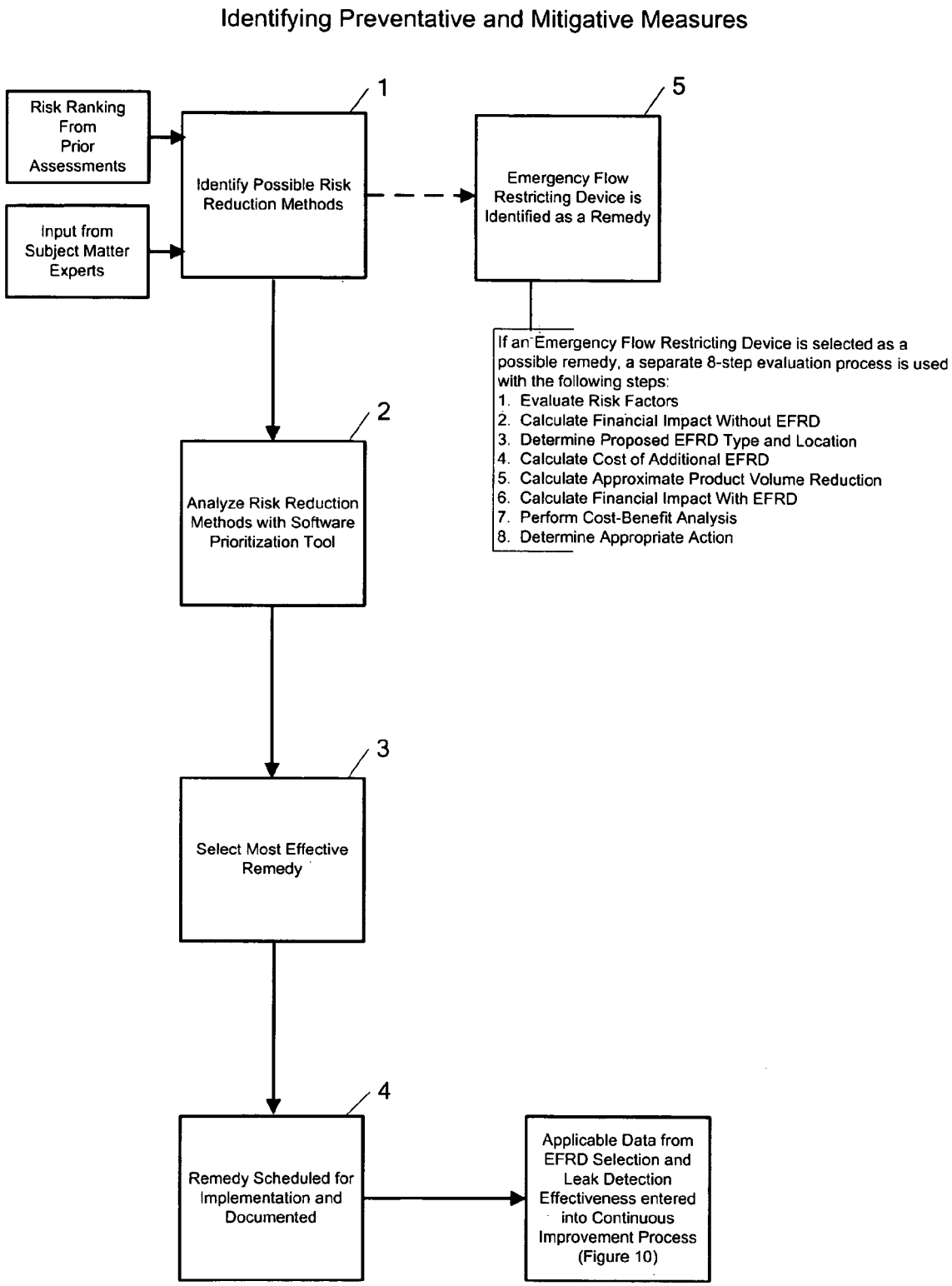
FIG. 9 is a block diagram showing steps for identifying preventive and mitigative measures.

FIG. 9 sets forth the steps for Identifying Preventative and Mitigative Measures.

During the Risk Assessment Phase, pipeline segment integrity threats (risks) were ranked as "Low", "Medium" or "High" (see FIG. 6, Item 4). Those pipeline segments with a specific threat that ranked "Medium" or "High" are identified (FIG. 9, Item 1) to receive additional Preventative and Mitigative Measures (PMMs) in an effort to enhance public safety and/or environmental protection. If such threat is ranked "Low", no further action is taken with respect to such pipeline asset. Risk reduction may occur by applying PMMs that reduce the likelihood of an accidental occurrence (spill) and/or by reducing the consequences of any occurrences.

Risk reduction remedies are determined by input from Subject Matter Experts and the most effective remedies are selected by using a computerized prioritization software tool (FIG. 9, Item 2) as described in U.S. patent application Ser. No. 10/864,129 filed Jun. 9, 2004. The software analyzes various PMMs, quantifies risk and helps identify the most effective mitigative actions at a reasonable cost. After analyzing all possible risk reduction remedies with the prioritization software tool, the most effective risk reduction remedy is selected for implementation taking into account cost as well as minimizing the risk (FIG. 9, Item 3).

If an Emergency Flow Restriction Device (EFRD) is evaluated as a possible PMM (FIG. 9, Item 5), then a separate evaluation procedure is started. This separate evaluation consists of eight steps including:

1. Evaluating Risk Factors
2. Calculating Financial Impact Without EFRD
3. Determining Proposed EFRD Type and Location
4. Calculating Cost of Additional EFRD
5. Calculating Approximate Product Volume Reduction With EFRD
6. Calculating Financial Impact With EFRD
7. Performing Cost-Benefit Analysis
8. Determining Appropriate Action The remedy selected for a specific threat is then documented and scheduled for implementation (FIG. 9, Item 4). The implementation of the selected remedy may be documented in several ways including:

Through an Audit and Incident Tracking Form

On a Project Idea Form

Through a Change Request Form

The prescribed documentation is necessary for scheduling, tracking and budgetary purposes.

After identification and implementation of preventative and mitigative measures for a pipeline segment is completed, the risk assessment data (from Risk Assessment Phase—FIG. 6) is modified as necessary.

Figure 10:
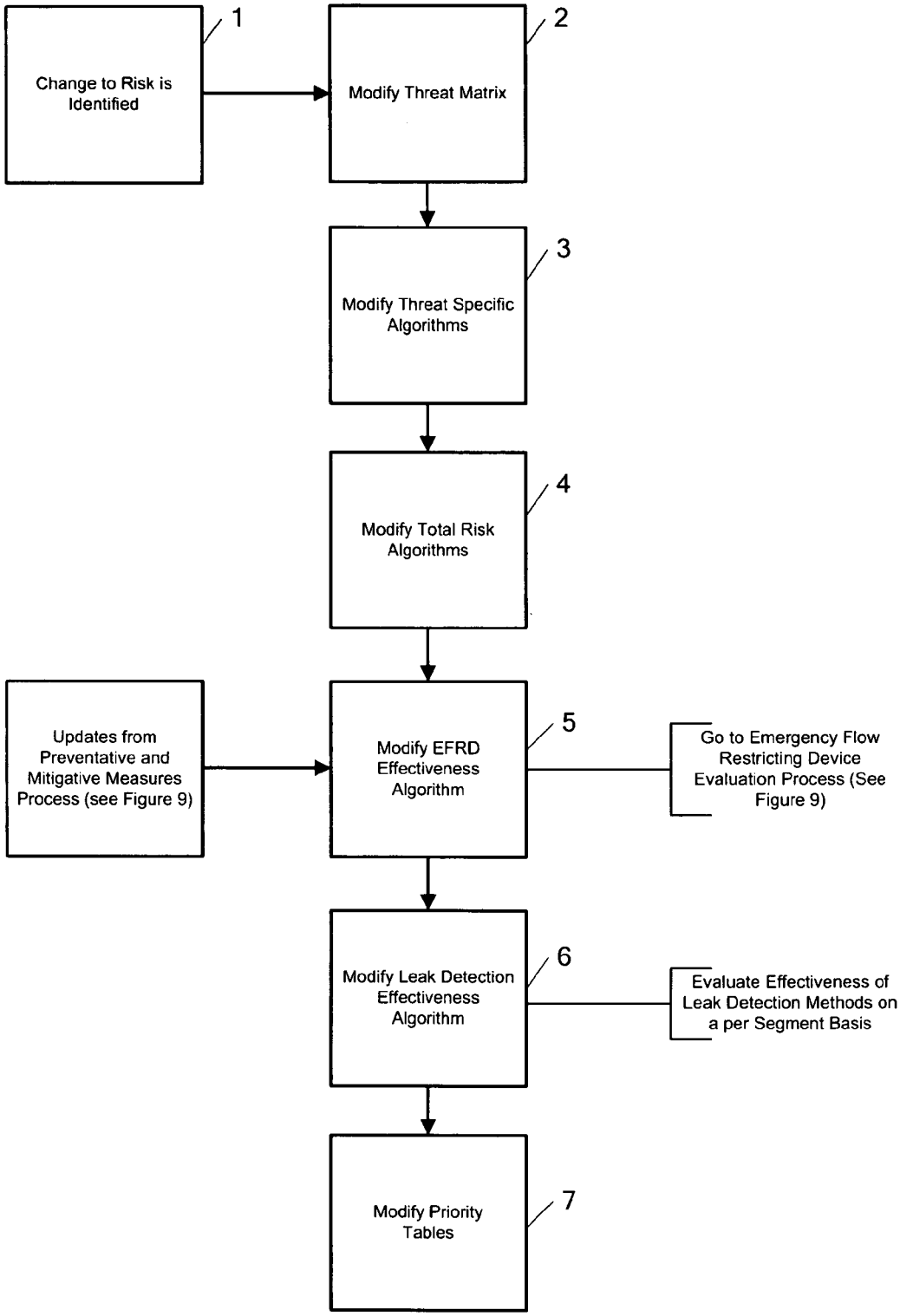
FIG. 10 is a block diagram showing steps for showing continuous improvement.

The steps for Continuous Improvement for the risk assessment phase and for the preventive and mitigative phase are set forth in FIG. 10.

The Continuous Improvement phase starts when the Integrity Management Program Project Leader identifies a new threat or risk to a pipeline asset (FIG. 10, Item 1). Upon discovery of a new threat to an asset, the pipeline threat matrix data is modified to include the new threat(s) (FIG. 10, Item 2). After the threat matrix has been modified, an algorithm or formula for ranking any new threats is completed jointly by a variety of personnel familiar with the pipeline asset (FIG. 10, Item 3). If a change in the Total Risk algorithm or formula is warranted, it is changed at this time (FIG. 10, Item 4). If an Emergency Flow Restricting Device (EFRD) was identified as a preventative or mitigative measure on a pipeline segment (see FIG. 9), the eight step EFRD evaluation process set forth in FIG. 9 is implemented. During the process of identifying preventative and mitigative measures for a given pipeline segment (FIG. 9), the effectiveness of any leak detection measures are evaluated on a per pipeline segment basis. (FIG. 10, Item 6). As a result of the threat matrix being updated with the data from the various input points specified above, risk priority tables are modified as warranted (FIG. 10, Item 7).

In addition to the procedures and steps outlined above, this Integrity Management Program incorporates additional elements involving Program Metrics and a Continuous Improvement Process, procedures for Personnel Qualification, and a standard for Records Management.

Program Metrics and Continuous Improvement Steps

Program performance metrics provide feedback to evaluate the effectiveness of the Integrity Management Program. Through performance tracking, program metrics are used to evaluate and modify the program using a continuous improvement approach that incorporates lessons learned and trend analysis. Analysis of program metrics allow the identity of which activities of the program should be continued, enhanced, modified or discontinued.

Program metrics include:

Incident investigation and lessons learned

Segment specific activities

Overall program activities

By evaluating program metrics in this fashion the Integrity Management Program is continuously improved with a goal of meeting annual performance objectives of management.

Personnel Qualification

The process for reviewing pipeline integrity assessments and performing information analysis utilizes input from various Project Leaders and Subject Matter Experts. Qualification of personnel is an important feature of the program and includes three qualification methods, namely:

Qualifying by previous experience. This includes Project Leaders who have been satisfactorily performing all duties as required by the program on an ongoing basis.

Qualifying by a mentor program. This includes placing personnel knowledgeable in pipelines and pipeline operating and maintenance under the direct supervision of a qualified project leader.

Qualification by testing. Individuals may qualify as Project Leaders by successfully completing a formal testing program, measuring knowledge of pipelines, pipeline operating, maintenance and construction techniques and pipeline integrity management techniques. As final proof of qualification, individuals will be required to perform a "mock" assessment from real data performed on an existing pipeline.

Method for Records Management

All documentation generated as part of the Integrity Management Program is maintained either electronically on a centralized company intranet and/or on hard copies maintained in a centralized company fileroom.

As use herein, the term "related assets" in connection with pipelines or pipeline segments shall include those items set forth in the definitions of "pipeline facility" and "pipeline system" in 49 CFR 195.2, namely pipeline facility means new and existing pipe, rights-of-way, and any equipment, facility, or building used in the transportation of hazardous liquids or carbon dioxide.

Pipeline or pipeline system means all parts of a pipeline facility through which a hazardous liquid or carbon dioxide moves in transportation, including, but not limited to, line pipe, valves and other appurtenances connected to line pipe, pumping units, fabricated assemblies associated with pumping units, metering and delivery stations and fabricated assemblies therein, and breakout tanks.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A method of creating data related to management of the operation of a pipeline, the data being available for immediate display or stored for future display, the method comprising the steps of:

(a) identifying pipeline segments and/or related assets in which a spill could effect an area of high consequence;

(b) developing a database of geological information for said segments on a segment by segment basis and/or related assets on an asset by asset basis;

(c) estimating worst case release data for said pipeline segment and/or said related assets; and (d) developing a baseline threat assessment for said pipeline segments including for various ones of said pipeline segments (i) collecting construction data, operational data, inspection data and incident data;

(ii) developing an integrity threat matrix;

(iii) evaluating risk factors including long seam susceptibility, corrosion and evaluating said integrity matrix;

(iv) ranking risks and establishing prioritization of corrective actions for said segments including the steps of developing an algorithm for said pipeline segments based upon evaluation of risks for specific ones of said pipeline segments and incorporating said algorithm in a computer interface;

(v) developing a continuous improvement program which includes one or more of the following (1) identifying a change to a risk;

(2) modifying said threat matrix based on said change;

(3) modifying threat specific algorithms; and (4) modifying total risk algorithms; and wherein said continuous improvement program further includes (a) reviewing existing data for specific pipeline segments;

(b) determining appropriate testing methods for said segments; and (c) calculating appropriate time interval for reassessment.

2. The process of claim 1 further including the step of modifying the effectiveness algorithm of emergency flow restriction devices.

3. The process of claim 1 further including the step of modifying the effectiveness algorithm of leak detection.

4. The process of claim 1 further including the step of modifying priority of action to be taken.

* * * * *